US007204023B2

(12) United States Patent
Chang

(10) Patent No.: US 7,204,023 B2
(45) Date of Patent: Apr. 17, 2007

(54) ROTARY CUTTER

(76) Inventor: Pi-Chao Chang, No. 35, David Road, Dali City, Taichung Hsien 412 (TW)

( * ) Notice: Subject to any disclaimer, the term of this patent is extended or adjusted under 35 U.S.C. 154(b) by 225 days.

(21) Appl. No.: 11/028,437

(22) Filed: Dec. 30, 2004

(65) Prior Publication Data

US 2006/0236551 A1 Oct. 26, 2006

(51) Int. Cl.
*B26B 1/08* (2006.01)
*B26B 29/02* (2006.01)

(52) U.S. Cl. ..... 30/319; 30/162; 30/292; 30/2

(58) Field of Classification Search ..... 30/319, 30/292, 307, 162, 312, 320, 159–161, 293, 30/154, 2, 306, 321; D8/98; 42/58–59; 292/335; 76/15
See application file for complete search history.

(56) References Cited

U.S. PATENT DOCUMENTS 4,713,885 A * 12/1987 Keklak et al. ..... 30/162
5,299,355 A * 4/1994 Boda et al. ..... 30/162
5,765,289 A 6/1998 Schlz et al. ..... 30/319
6,189,218 B1 2/2001 Okada ..... 30/162
2003/0131483 A1* 7/2003 Carlson et al. ..... 30/319
2004/0187318 A1* 9/2004 Mathieu et al. ..... 30/319
2005/0086811 A1* 4/2005 Kawasaki ..... 30/162

* cited by examiner

*Primary Examiner*—Boyer D. Ashley
*Assistant Examiner*—Laura M. Brean
(74) *Attorney, Agent, or Firm*—Charles E. Baxley

(57) ABSTRACT

A rotary cutter includes a housing, a swing member rotatably attached to the housing and having a trigger extended out of the housing and having a curved slot and an enlarged opening communicating with each other. A button is slidably engaged through the housing, and includes a reduced stud to engage into the curved slot of the swing member, and a latch having an outer diameter to prevent the latch from engaging into the curved slot of the swing member. A link is coupled to the swing member, and includes a pole slidably engaged in the curved channel of the housing, and a rotary cutter blade is secured to the link with a shaft, to allow the cutter blade to be moved into and out of the working end portion of the housing by the link and the swing member.

8 Claims, 5 Drawing Sheets

ROTARY CUTTER

BACKGROUND OF THE INVENTION

1. Field of the Invention

The present invention relates to a rotary cutter, and more particularly to a rotary cutter having a retractable and receivable cutter blade.

2. Description of the Prior Art

Various kinds of typical rotary cutters have been developed and comprise a generally circular cutter blade rotatably mounted on a shaft, and extending through an aperture formed in a platform, and a blade guard rotatably attached to the platform, and having an arcuate portion rotatable relative to the platform, to selectively cover or shield the cutter blade.

For example, U.S. Pat. No. 5,765,289 to Schulz et al. discloses one of the typical rotary cutters comprising a blade guard rotatably attached to a platform and having an arcuate portion for rotatable relative to the platform, to selectively cover or shield the cutter blade. The blade guard includes engaging portions in the form of ridges, for allowing the blade guard to be rotated relative to the platform by the users.

However, the users may have to use one of their hands to hold or grasp the handle of the rotary cutter, and the other hand to rotate the blade guard relative to the platform, such that the typical rotary cutters may not be easily operated by the users.

U.S. Pat. No. 6,189,218 to Okada discloses another typical rotary cutter comprising a swing member rotatably attached to a cutter body, a rotary blade rotatably attached to the swing member, and movable in and out of the cutter body with a trigger lever of the swing member, and a complicated key member is required to be provided and operated by the users to lock the swing member and thus the rotary blade to the cutter body.

However, the rotary blade is directly and rotatably attached to the swing member, such that the users have to spend or to apply a greater force to rotate the swing member, in order to move the rotary blade out of the cutter body. In addition, the users have to depress the complicated key member into the cutter body by the users themselves, in order to lock the swing member and the rotary blade to the cutter body.

The present invention has arisen to mitigate and/or obviate the afore-described disadvantages of the conventional rotary cutters.

SUMMARY OF THE INVENTION

The primary objective of the present invention is to provide a rotary cutter including a retractable and receivable cutter blade to allow the cutter blade to be forced out of a housing to a working position, and to be retracted into the housing to a folding or receiving position, to allow the cutter blade to be suitably received and shielded within the housing, and to be prevented from hurting users.

In accordance with one aspect of the invention, there is provided a rotary cutter comprising a housing including a working end portion, and a handle portion for being held by users, and including a passage formed therein, and including a curved channel formed therein, a swing member rotatably attached to the housing with a pivot axle, and including a trigger provided thereon and extended out through the passage of the housing, and including a curved slot and an enlarged opening formed therein and communicating with each other, and the curved slot of the swing member including a center of curvature located at the pivot axle, a button slidably engaged out through the housing, and including a latch provided thereon, and including a peripheral groove formed therein to form a diameter reduced stud therein, and to allow the diameter reduced stud to slidably engage into the curved slot of the swing member, the latch of the button includes an outer diameter greater than a width of the curved slot of the swing member, to prevent the latch of the button from engaging into the curved slot of the swing member, and the outer diameter of the latch of the button is no greater than the outer diameter of the opening of the swing member, to allow the latch to engage into the opening of the swing member, the diameter reduced stud of the button includes an outer diameter no greater than the width of the curved slot of the swing member, to allow the diameter reduced stud of the button to slidably engage into the curved slot of the swing member, a first biasing device is provided for biasing the latch of the button to engage into the opening of the swing member and to lock the swing member to the housing when the diameter reduced stud of the button is disengaged from the curved slot of the swing member, a link is pivotally coupled to the swing member, and includes a pole provided thereon and slidably engaged in the curved channel of the housing, to guide the link to move relative to the working end portion and the housing, the pole includes a bore formed therein for receiving a shaft therein, a rotary cutter blade is secured to the link with the shaft, to allow the cutter blade to be moved into and out of the working end portion of the housing by the link, and a second biasing device is provided for rotating the swing member relative to the housing, and to bias and force the trigger out through the passage of the housing, and to force the diameter reduced stud to slidably engage into the curved slot of the swing member when the latch of the button is disengaged from the opening of the swing member, and the latch of the button is biased to engage into the opening of the swing member by the second biasing device when the diameter reduced stud is disengaged from the curved slot of the swing member.

The swing member includes a coupler provided thereon, and the link includes a pivot rod formed or provided on one end thereof and rotatably coupled to the coupler of the swing member to pivotally couple the link to the swing member. The housing includes a width reduced neck portion formed therein and located between the working end portion and the handle portion, and having the passage formed therein.

The shaft includes a threaded end engaged through the bore of the pole, and threaded with a lock nut, to secure the cutter blade to the link. The cutter blade includes a sector secured thereto with the shaft, to partially cover and protect the cutter blade, and to prevent the shaft from being engaged with the cutter blade.

The housing includes two housing members secured together, and each having a curved channel formed therein and aligned with each other. The housing members each includes a hole formed therein, to rotatably receive the pivot axle of the swing member.

The housing includes a projection extended therein and having a cavity formed therein, to partially receive the latch of the button. The first biasing device includes a spring member engaged into the cavity of the projection of the housing, and engaged between the housing and the button, to bias the latch of the button to engage into the opening of the swing member and to lock the swing member to the housing when the diameter reduced stud of the button is disengaged from the curved slot of the swing member.

The housing includes a peg extended therefrom, and swing member includes a protrusion extended therefrom, and the second biasing device includes a spring member coupled between the protrusion of the swing member and the peg of the housing, to force and rotate the swing member relative to the housing, and to bias and force the trigger out through the passage of the neck portion.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
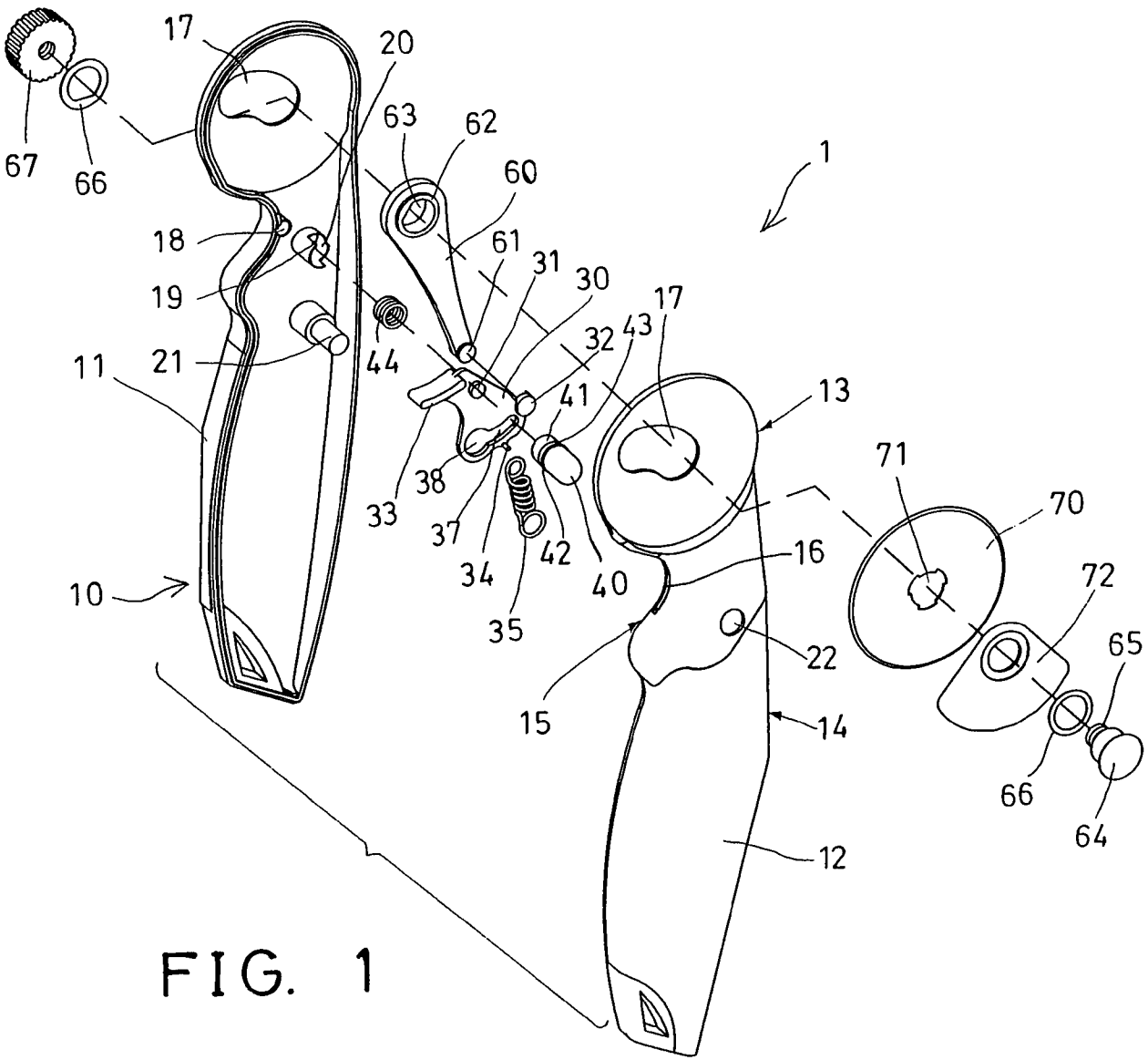
FIG. 1 is an exploded view of a rotary cutter in accordance with the present invention.
Figure 2:
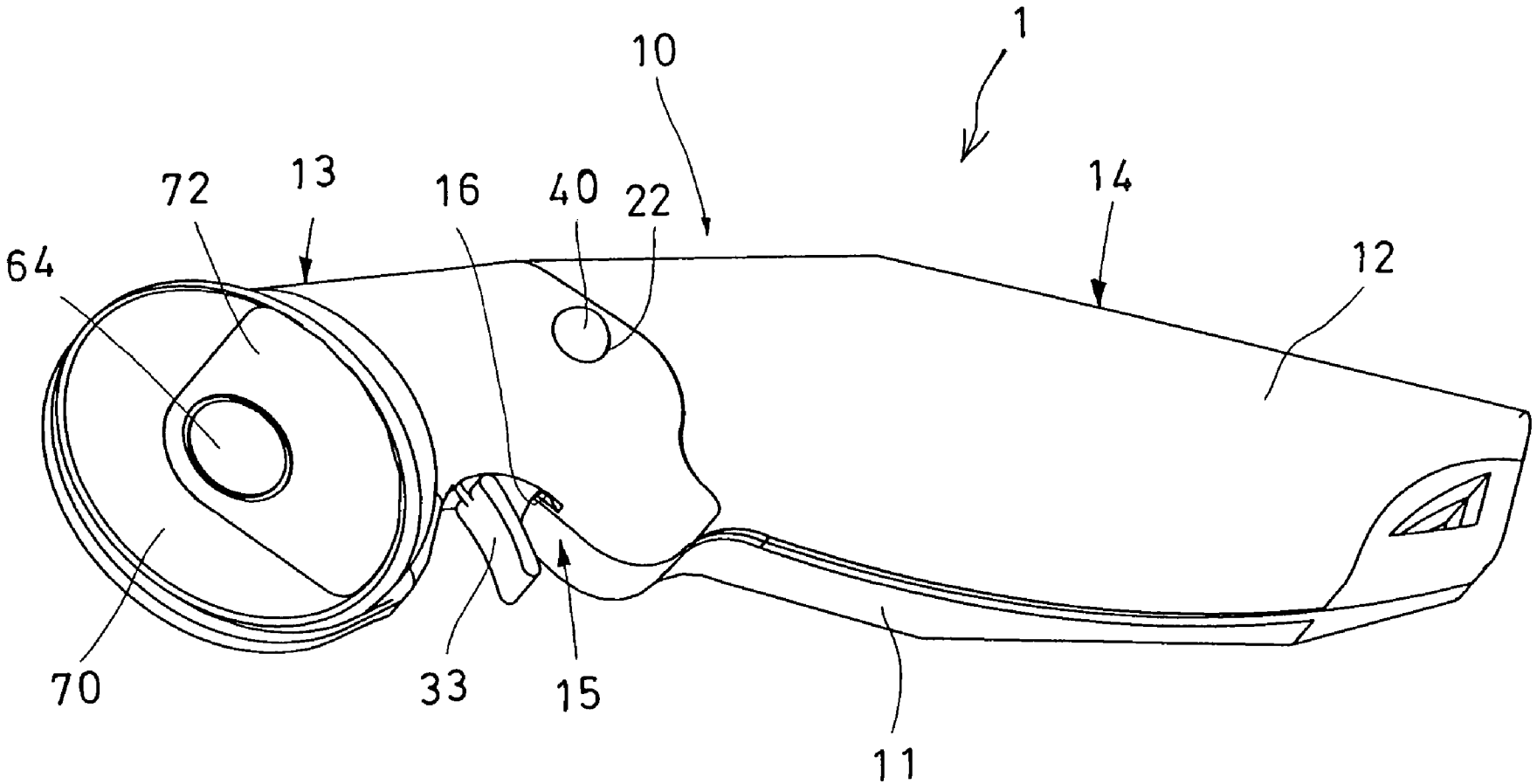
FIG. 2 is a perspective view of the rotary cutter.
Figure 3:
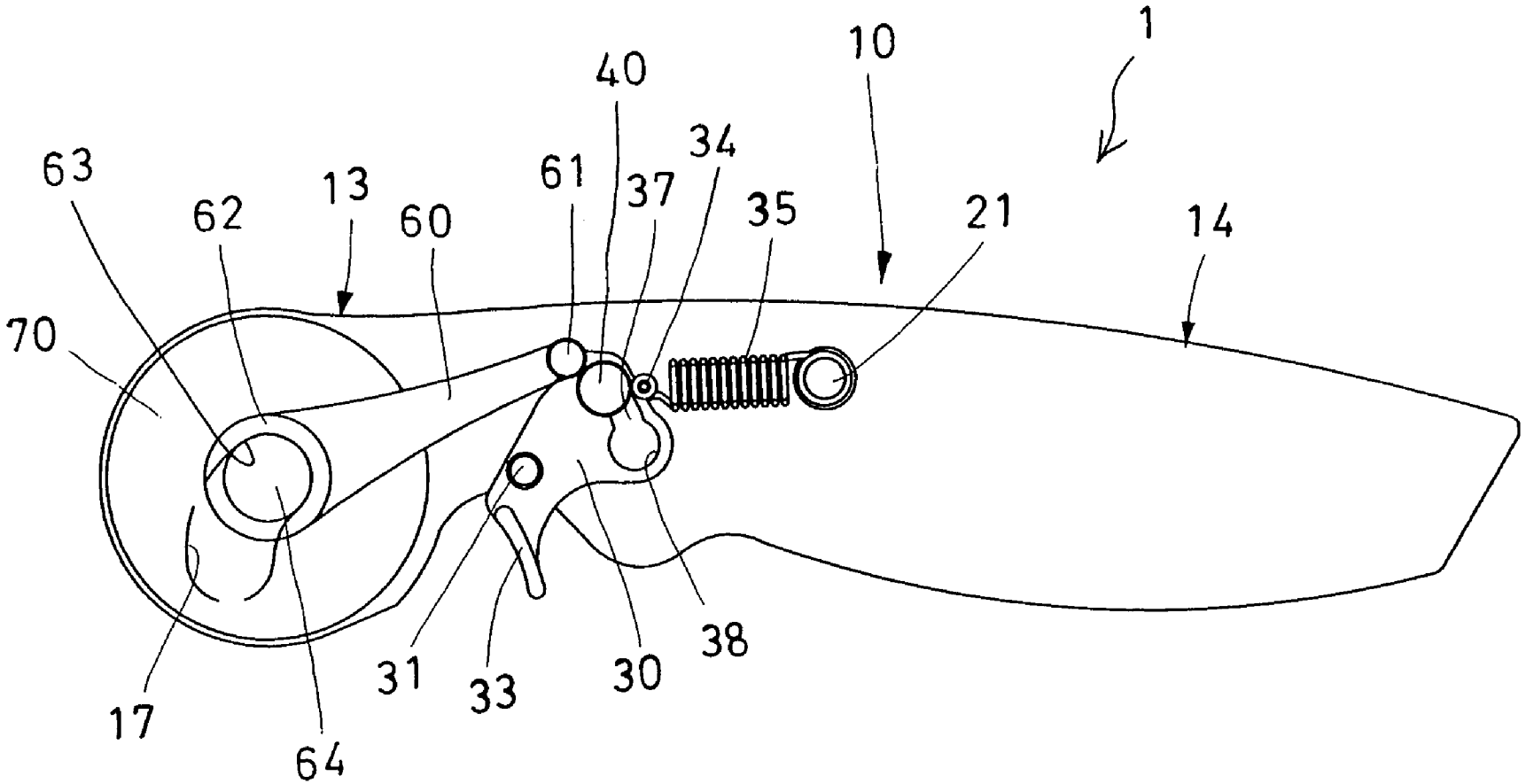
FIG. 3 is a plan view of the rotary cutter as shown in FIG. 2, in which one half of the outer housing has been removed, to show an inner structure of the rotary cutter.

Referring to the drawings, and initially to FIGS. 1-3, a rotary cutter 1 in accordance with the present invention comprises a housing 10 including such as two housing members 11, 12 secured together with fasteners (not shown), adhesive materials, or by welding processes, and including a head or a front end or a working end portion 13, and a handle portion 14 for being held or grasped by users, and including a width reduced neck portion 15 located between the working end portion 13 and the handle portion 14 and having a passage 16 formed therein.

The housing 10 includes one or more curved channel 17 formed therein, such as two curved channels 17 formed in the housing members 11, 12 respectively, and aligned with each other. Each of the housing members 11, 12 includes a hole 18 formed therein, and one of the housing members 11 includes a projection 19 extended therefrom and having a cavity 20 formed therein, and a peg 21 extended therefrom and spaced away from the projection 19. The other housing member 12 includes an orifice 22 formed therein and aligned with the cavity 20 of the projection 19.

A swing member 30 includes a pivot axle 31 extended therefrom, for rotatably engaging into the holes 18 of the housing members 11, 12, to rotatably or pivotally attach the swing member 30 to the housing 10, and includes a hub or a coupler 32 formed or provided thereon, and a trigger 33 formed or provided thereon and located opposite to the coupler 32, or arranged to have the pivot axle 31 located between the coupler 32 and the trigger 33. The trigger 33 is extended out through the passage 16 of the neck portion 15.

The swing member 30 further includes a protrusion 34 extended therefrom, and a spring member 35 coupled between the protrusion 34 of the swing member 30 and the peg 21 of the housing 10, to rotate the swing member 30 relative to the housing 10, and to bias or to force the trigger 33 out through the passage 16 of the neck portion 15, best shown in FIGS. 2 and 3. The swing member 30 further includes a curved slot 37 formed therein and having a center of curvature located at the pivot axle 31, and an enlarged opening 38 formed therein and communicating with the curved slot 37 thereof.

A button 40 is slidably engaged or extended out through the orifice 22 of the housing member 12 or of the housing 10, and includes a latch 41 formed or provided in one end or inner end 41 thereof and slidably received within the cavity 20 of the projection 19, and includes a peripheral groove 42 formed therein, such as formed in a middle or intermediate portion thereof, to form or define a diameter reduced stud 43 therein (FIG. 1), and to slidably engage into the curved slot 37 of the swing member 30.

The inner end 41 or the latch 41 of the button 40 includes an outer diameter greater than the width of the curved slot 37 of the swing member 30, to prevent the latch 41 of the button 40 from engaging into the curved slot 37 of the swing member 30, and the outer diameter of the latch 41 of the button 40 is equals to or smaller than or no greater than the outer diameter of the opening 38 of the swing member 30, to allow the latch 41 to engage into the opening 38 of the swing member 30.

The diameter reduced stud 43 of the button 40 includes an outer diameter equals to or smaller than or no greater than the width of the curved slot 37 of the swing member 30, to allow the diameter reduced stud 43 of the button 40 to slidably engage into the curved slot 37 of the swing member 30. A spring member 44 may further be provided and engaged into the cavity 20 of the projection 19 of the housing member 12 or of the housing 10, and engaged between the housing 10 and the button 40, to bias the latch end 41 of the button 40 into the opening 38 of the swing member 30.

For example, when the diameter reduced stud 43 of the button 40 is disengaged from the curved slot 37 of the swing member 30, the spring member 44 may bias and force the latch end 41 of the button 40 into the opening 38 of the swing member 30 (FIG. 5), to lock the swing member 30 to the housing 10, and thus to prevent the swing member 30 from being moved or rotated relative to the housing 10, and thus to prevent the trigger 33 of the swing member 30 from being depressed or actuated by the users.

A link 60 includes a pivot rod 61 formed or provided on one end thereof and rotatably coupled to the coupler 32 of the swing member 30, to pivotally or rotatably couple the link 60 to the swing member 30. The link 60 further includes a hub or a pole 62 formed or provided on the other end thereof and slidably engaged in the hub or coupler 32 of the curved channels 17 of the housing 10, to guide the link 60 to move relative to the working end portion 13 and the housing 10. The pole 62 includes a passage or bore 63 formed therein for receiving a shaft 64 therein.

The shaft 64 may include a threaded end 65 formed thereon, and engageable through a bore 71 of a rotary cutter blade 70, and engageable through one or more washers 66, and engageable through the bore 63 of the pole 62, and threaded with a lock nut 67, to secure the cutter blade 70 to the link 60, and thus to allow the cutter blade 70 to be moved into and out of the working end portion 13 of the housing 10 by the link 60. It is preferable that a sector 72 is further provided and secured to the cutter blade 70 with the shaft 64, to partially cover or protect the cutter blade 70, and to prevent the shaft 64 from being directly engaged with the cutter blade 70.

In operation, as shown in FIGS. 2 and 3, the trigger 33 of the swing member 30 may be biased and forced out through the passage 16 of the neck portion 15 of the housing 10 by the spring member 35, and the link 60 may be moved inwardly into the handle portion 14 of the housing 10, in order to pull and to move the cutter blade 70 into the working end portion 13 of the housing 10. At this moment, the diameter reduced stud 43 of the button 40 is forced to slide or to engage into the curved slot 37 of the swing member 30.

Figure 4:
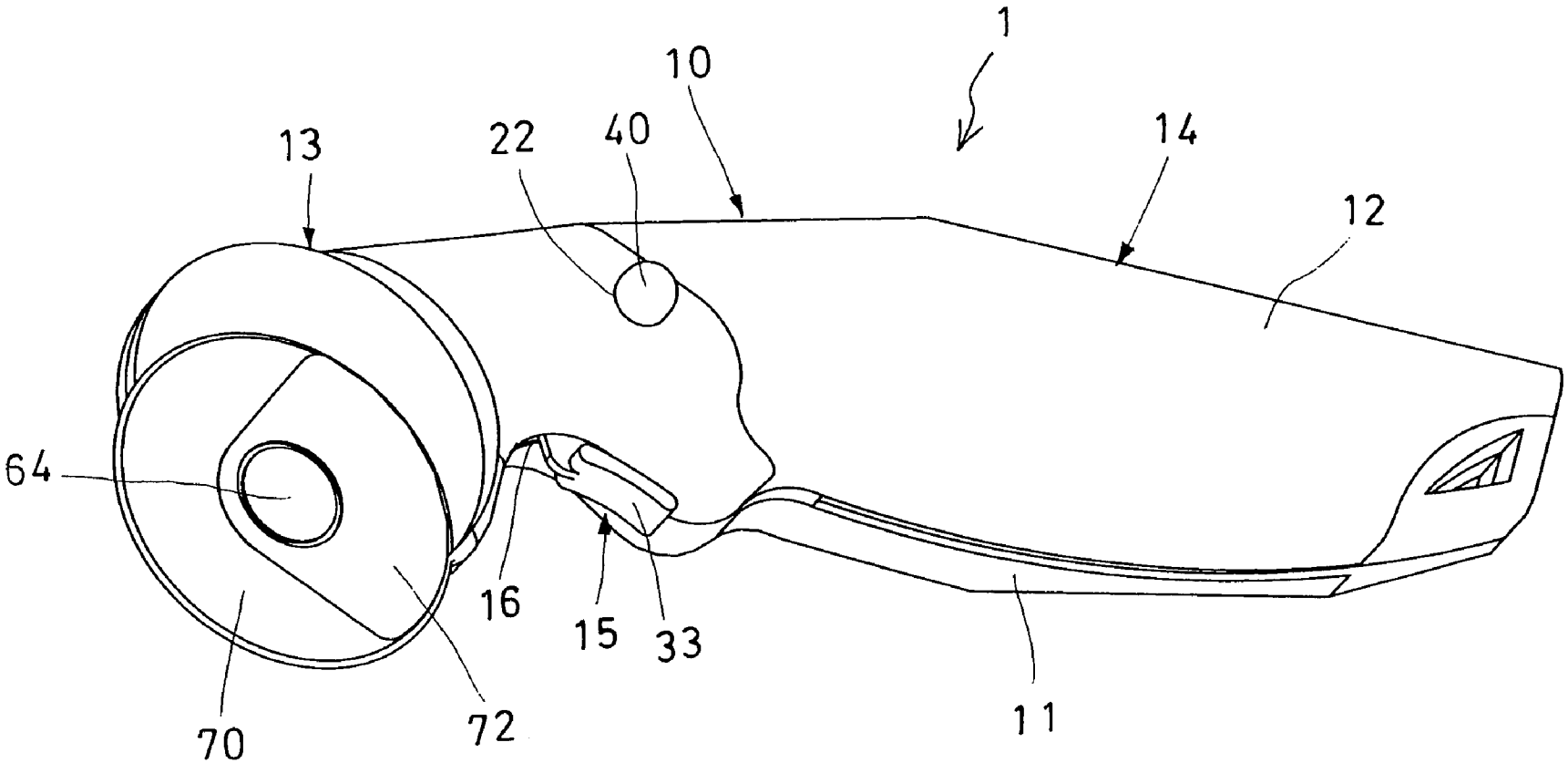
FIG. 4 is a perspective view similar to FIG. 2, illustrating the operation of the rotary cutter.
Figure 5:
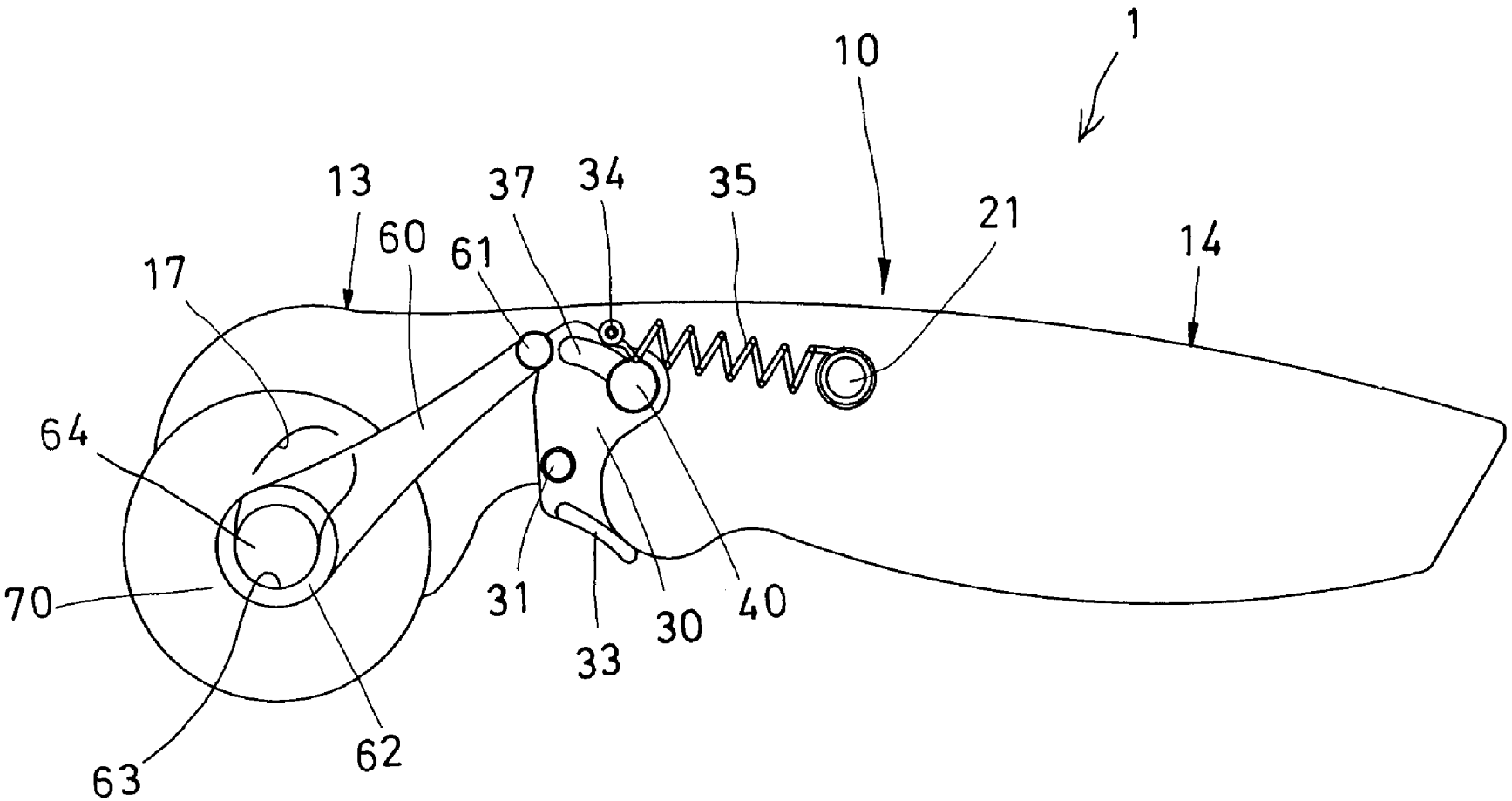
FIG. 5 is a plan view of the rotary cutter as shown in FIG. 4, in which one half of the outer housing has also been removed, to show an inner structure of the rotary cutter.

As shown in FIGS. 4 and 5, when the trigger 33 of the swing member 30 is pulled toward or forced into the neck portion 15 of the housing 10 by the users against the spring member 35, the swing member 30 may also be rotated relative to the housing 10, in order to move or to force the cutter blade 70 out of the working end portion 13 of the housing 10 with the link 60.

When the diameter reduced stud 43 of the button 40 is disengaged from the curved slot 37 of the swing member 30, the spring member 44 may bias and force the latch end 41 of the button 40 into the opening 38 of the swing member 30 (FIG. 5), to lock the swing member 30 to the housing 10, and to prevent the swing member 30 from being moved or rotated relative to the housing 10, and thus to prevent the trigger 33 of the swing member 30 from being further depressed or actuated by the users. The cutter blade 70 may thus be retained and extended out of the working end portion 13 of the housing 10 for conducting cutting operations.

After working operation, or when it is no longer required to use the cutter blade 70, the button 40 may be depressed into the housing 10 by the users, to disengage the latch end 41 of the button 40 from the opening 38 of the swing member 30, and to align the diameter reduced stud 43 of the button 40 with the curved slot 37 of the swing member 30, and thus to release the swing member 30 relative to the housing 10, and to allow the diameter reduced stud 43 of the button 40 to be forced to slide or to engage into the curved slot 37 of the swing member 30 by the spring member 35, in order to rotate the cutter blade 70 into the working end portion 13 of the housing 10, and to bias and force the trigger 33 of the swing member 30 out through the passage 16 of the neck portion 15 of the housing 10 again, and to wait for next triggering operation.

It is to be noted the latch end 41 of the button 40 may be automatically biased and forced into the opening 38 of the swing member 30 by the spring member 44, to lock the swing member 30 to the housing 10, and to prevent the swing member 30 from being moved or rotated relative to the housing 10, and thus to prevent the cutter blade 70 from being forced into the working end portion 13 of the housing 10 after the trigger 33 of the swing member 30 has been depressed or actuated by the users, such that the users are not required to depress or to actuate the button 40, and may thus easily operate the rotary cutter device.

Accordingly, the rotary cutter in accordance with the present invention includes a retractable and receivable cutter blade to allow the cutter blade to be forced out of a housing to a working position, and to be retracted into the housing to a folding or receiving position, to allow the cutter blade to be suitably received and shielded within the housing, and to be prevented from hurting users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rotary cutter comprising:

a housing including a working end portion, and a handle portion for being held by users, and including a passage formed therein, and including a curved channel formed therein, and including a projection having a cavity formed therein, a swing member rotatably attached to said housing with a pivot axle for allowing said swing member to be rotated relative to said housing, and including a trigger provided thereon and extended out through said passage of said housing, and including a curved slot and an enlarged opening formed therein and communicating with each other, and said curved slot of said swing member including a center of curvature located at said pivot axle, a button slidably engaged out through said housing, and including a latch provided thereon and partially received in said cavity of said projection of said housing, and including a peripheral groove formed therein to form a diameter reduced stud therein, and to allow said diameter reduced stud to slidably engage into said curved slot of said swing member, said latch of said button including an outer diameter greater than a width of said curved slot of said swing member, to prevent said latch of said button from engaging into said curved slot of said swing member, and said outer diameter of said latch of said button being no greater than said outer diameter of said opening of said swing member, to allow said latch to engage into said opening of said swing member, said diameter reduced stud of said button including an outer diameter no greater than said width of said curved slot of said swing member, to allow said diameter reduced stud of said button to slidably engage into said curved slot of said swing member, a first biasing means for biasing said latch of said button to engage into said opening of said swing member and to lock said swing member to said housing when said diameter reduced stud of said button is disengaged from said curved slot of said swing member, said first biasing means including a spring member engaged into said cavity of said projection of said housing, and engaged between said housing and said button, to bias said latch of said button to engage into said opening of said swing member and to lock said swing member to said housing when said diameter reduced stud of said button is disengaged from said curved slot of said swing member, a link including a pivot rod formed or provided on one end thereof and pivotally coupled to said swing member, and including a pole provided thereon and slidably engaged in said curved channel of said housing, to guide said link to move relative to said working end portion and said housing, said pole including a bore formed therein for receiving a shaft therein, a rotary cutter blade secured to said link with said shaft, to allow said cutter blade to be moved into and out of said working end portion of said housing by said link, and a second biasing means for rotating said swing member relative to said housing, and to bias and force said trigger out through said passage of said housing, and to force said diameter reduced stud to slidably engage into said curved slot of said swing member when said latch of said button is disengaged from said opening of said swing member, and said latch of said button being biased to engage into said opening of said swing member by said second biasing means when said diameter reduced stud is disengaged from said curved slot of said swing member.

2. The rotary cutter as claimed in claim 1, wherein said swing member includes a coupler provided thereon, and said pivot rod of said link is rotatably coupled to said coupler of said swing member to pivotally couple said link to said swing member.

3. The rotary cutter as claimed in claim 1, wherein said shaft includes a threaded end engaged through said bore of said pole, and threaded with a lock nut, to secure said cutter blade to said link.

4. The rotary cutter as claimed in claim 3, wherein said cutter blade includes a sector secured thereto with said shaft, to partially cover and protect said cutter blade, and to prevent said shaft from being engaged with said cutter blade.

5. The rotary cutter as claimed in claim 1, wherein said housing includes a width reduced neck portion formed therein and located between said working end portion and said handle portion, and having said passage formed therein.

6. The rotary cutter as claimed in claim 1, wherein said housing includes two housing members secured together, and each having a curved channel formed therein and aligned with each other.

7. The rotary cutter as claimed in claim 6, wherein said housing members each includes a hole formed therein, to rotatably receive said pivot axle of said swing member.

8. The rotary cutter as claimed in claim 1, wherein said housing includes a peg extended therefrom, and said swing member includes a protrusion extended therefrom, and said second biasing means includes a spring member coupled between said protrusion of said swing member and said peg of said housing, to force and rotate said swing member relative to said housing, and to bias and force said trigger out through said passage of said neck portion.

* * * * *